US011499704B1

(12) United States Patent
Liu et al.

(10) Patent No.: US 11,499,704 B1
(45) Date of Patent: Nov. 15, 2022

(54) LAMP POWER SUPPLY

(71) Applicant: ZHONGSHAN MULINSEN PHOTOELECTRICITY CO., LTD., Zhongshan (CN)

(72) Inventors: Tianming Liu, Zhongshan (CN); Zhengwei Zhou, Zhongshan (CN); Ti Xin, Zhongshan (CN)

(73) Assignee: ZHONGSHAN MULINSEN PHOTOELECTRICITY CO., LTD., Guangdong Province (CN)

( * ) Notice: Subject to any disclaimer, the term of this patent is extended or adjusted under 35 U.S.C. 154(b) by 0 days.

(21) Appl. No.: 17/392,406

(22) Filed: Aug. 3, 2021

(51) Int. Cl.
*F21V 23/02* (2006.01)
*F21V 31/00* (2006.01)
*F21V 15/015* (2006.01)

(52) U.S. Cl.
CPC ..... *F21V 23/023* (2013.01); *F21V 15/015* (2013.01); *F21V 31/005* (2013.01)

(58) Field of Classification Search
CPC ..... F21V 23/023; F21V 15/015; F21V 31/005
See application file for complete search history.

(56) References Cited

U.S. PATENT DOCUMENTS 5,744,934 A * 4/1998 Wu ..... H01R 27/00 320/111
6,362,987 B1 * 3/2002 Yurek ..... H01R 29/00 363/146
9,788,374 B1 * 10/2017 Holleschau ..... F21S 8/061
11,112,067 B1 * 9/2021 Liao ..... H05B 47/11
2005/0233633 A1 * 10/2005 Chien ..... H01R 13/6691 439/502
2006/0011460 A1 * 1/2006 Hung ..... H01H 23/205 200/315
2006/0039146 A1 * 2/2006 Wu ..... F21V 23/04 362/235
2007/0076438 A1 * 4/2007 Chien ..... F21V 33/0024 362/641
2011/0009005 A1 * 1/2011 Youssefi-Shams .... H01R 31/06 439/628
2016/0025316 A1 * 1/2016 Chien ..... G06F 1/266 29/595
2017/0097149 A1 * 4/2017 Peng ..... H01R 24/68
2021/0148556 A1 * 5/2021 Pan ..... F21V 23/003
2022/0021848 A1 * 1/2022 Chien ..... F21V 21/14

* cited by examiner

*Primary Examiner* — Tsion Tumebo
(74) *Attorney, Agent, or Firm* — Karin L. Williams; Alan D. Kamrath; Mayer & Williams PC

(57) ABSTRACT

A lamp power supply includes: a housing, a main circuit board, and an end cover, where the circuit board is disposed in the housing, the end cover is connected to an open end of the housing, the end cover is provided with a through hole running through a surface of the end cover, a rubber stopper is disposed in the through hole, the rubber stopper includes an elastic pressing portion, an end of which protrudes upward from the surface of the end cover and an other end of which is located in the through hole, and the elastic pressing portion is connected with a conductive portion. The sub-circuit board is electrically connected to the conductive portion of the elastic pressing portion.

5 Claims, 14 Drawing Sheets

LAMP POWER SUPPLY

TECHNICAL FIELD

This invention relates to the technical field of drive power supplies, and specifically, to a lamp power supply.

BACKGROUND

A conventional lamp power supply switch usually adopts a mechanical switch inserted into a PCB, and the mechanical switch is pressed by using a silicone button on a housing, to control on/off of the lamp power supply. However, in the existing structure, the mechanical switch is inserted into a hole in the PCB through a pin, and the hole in the PCB is usually set to be larger than the pin, and as a result, the pin is easily caused to be inclinedly mounted on the PCB when inserting the mechanical switch into the PCB, resulting in a defective product.

SUMMARY

An objective of this invention is to provide a lamp power supply for resolving the disadvantages in the prior art. The lamp power supply can reduce the defective rate in the production of products.

The objective of this invention is implemented by the following technical solutions:

Provided is a lamp power supply, comprising a housing, a main circuit board, and an end cover, the circuit board being disposed in the housing and the end cover being connected to an open end of the housing, wherein the end cover is provided with a through hole running through a surface of the end cover, a rubber stopper is disposed in the through hole, and the rubber stopper comprises an elastic pressing portion protruding upward from the surface of the end cover and a conductive portion connected to a lower end of the elastic pressing portion and located in the through hole; and the lamp power supply further comprises a sub-circuit board electrically connected to the main circuit board, a first space is provided between the sub-circuit board and a bottom of the elastic pressing portion, and when the elastic pressing portion is pressed downward, the elastic pressing portion is capable of moving in the first space and enabling a circuit of the sub-circuit board to be in electrical contact with the conductive portion to generate a pulse signal, to switch a function of a power supply device.

The conductive portion is coated on the bottom of the elastic pressing portion.

The rubber stopper includes a mounting portion and the elastic pressing portion, the mounting portion includes an elastic portion and a lower clamp block connected to a bottom of the elastic portion, the elastic portion is annularly disposed and connected to the lower end of the elastic pressing portion, a base plate protrudes downward from a lower surface of the end cover, the through hole runs downward through the base plate and communicates upper and lower surfaces of the end cover, and the lower clamp block is located between the sub-circuit board and a bottom of the base plate.

An annular convex plate protrudes downward from a lower surface of the end cover, the convex plate coincides with a central axis of the through hole and is located on an outer side of the base plate, a recess is provided between the convex plate and the base plate, a connecting block protrudes upward from the lower clamp block and toward an interior of the recess, the base plate is capable of being inserted downward between the elastic portion and the connecting block, and when the rubber stopper is inserted into the through hole, the connecting block is inserted upward into the recess and the base plate is inserted downward between the elastic portion and the connecting block; with such the structural configuration, the base plate is used as a first waterproof ring, the connecting block is used as the second waterproof ring, the convex plate is clamped with the connecting block of the rubber stopper and is further used as a third waterproof ring while positioning the rubber stopper; and by disposing the base plate, the connecting block, and the convex plate in different orientations, there are three waterproof rings when the rubber stopper is fixedly connected to the end cover, to play a role of waterproof sealing.

The elastic portion is disposed inclinedly, an end of the elastic portion is connected to the lower end of the elastic pressing portion, and an other end of the elastic portion extends in a direction away from the elastic pressing portion; and by such the structural configuration, as compared with a vertically disposed elastic portion, the inclinedly disposed elastic portion is capable of providing a better elastic deformation, to better control a movement of the elastic pressing portion and enable the elastic pressing portion to quickly return to an original position after a pressing force is removed, thereby having a good resilience.

The rubber stopper further includes an upper clamp block, an end of the upper clamp block is connected to a top of the elastic pressing portion, and an other end of the upper clamp block extends downward and toward an upper surface of the end cover.

The rubber stopper further comprises a cylinder-shaped mounting portion for securing the rubber stopper onto the end cover, the mounting portion is hollow, a second space is provided in the mounting portion, the elastic pressing portion is connected to the mounting portion, the lower end of the elastic pressing portion is located in the second space, the sub-circuit board is connected to a bottom of the mounting portion, and the first space is communicated with the second space.

An upper clamp block and a lower clamp block respectively extend from top and bottom of the mounting portion in directions away from the elastic pressing portion, a base plate protrudes downward from a lower surface of the end cover, the through hole runs downward through the base plate and communicates upper and lower surfaces of the end cover, and the upper clamp block and the lower clamp block respectively collaborate with the upper surface of the end cover and the bottom of the base plate and secure the rubber stopper onto the end cover; and a top of the upper clamp block is provided with a guide portion capable of guiding the rubber stopper to be inserted into the through hole from bottom to top, and the guide portion is an inclined surface or a curved surface.

The rubber stopper is made of a black or white transparent or fluorescent material.

Beneficial effects of this invention: in the lamp power supply of this invention, the sub-circuit board is electrically connected to the conductive portion of the elastic pressing portion, and the conductive portion of the rubber stopper is in surface contact with the sub-circuit board, so that the fault tolerance of the whole structure is increased, the rubber stopper and the sub-circuit board have a good fastening performance and are not apt to separate from each other, thereby lowering the defective rate of products; the sub-circuit board is disposed to replace the conventional mechanical switch, thereby reducing the material cost; an upper end of the elastic pressing portion protrudes upward from the surface of the end cover, which is convenient for manual operation and pressing.

BRIEF DESCRIPTION OF THE ACCOMPANYING DRAWINGS

This invention is further explained by the accompanying drawings, but the embodiments in the accompanying drawings do not constitute any limitation to this invention, and a person of ordinary skill in the art may further obtain other drawings based on the following accompanying drawings without paying creative efforts.

Figure 1:
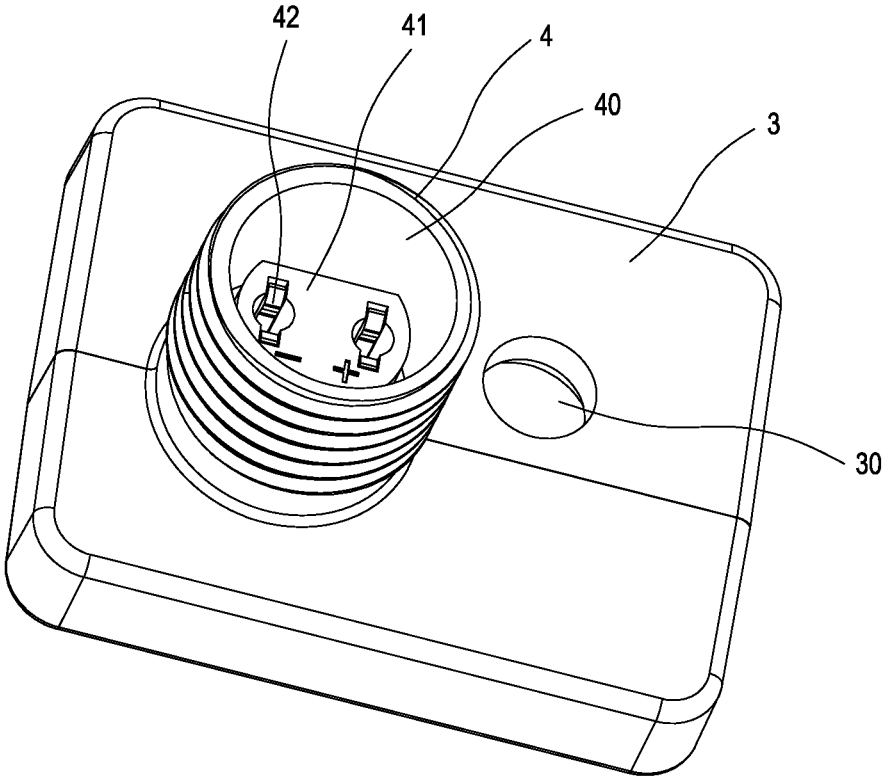
FIG. 1 is a schematic structural diagram of the drive power supply for a lamp at the side of the end cover of this invention.

FIG. 1 to FIG. 14 include:

housing 1, main circuit board 2, catching slot 20, end cover 3, through hole 30, rubber stopper 31, mounting portion 32, upper clamp block 320, lower clamp block 321, guide portion 322, elastic portion 323, connecting block 324, elastic pressing portion 33, second space 34, sub-circuit board 35, conductive portion 36, first space 37, convex block 38, convex plate 39, terminal post 4, receiving groove 40, boss 41, conductive hole 42, conductive sheet 43, insertion section 44, fastening section 45, conductive section 46, inverted teeth 47, U-shaped groove 48, conductive seat 5, first main board 50, second main board 51, first elastic sheet 52, second elastic sheet 53, first connecting sheet 54, second connecting sheet 55, first contact portion 56, second contact portion 57, insertion member 58, conductive pin 6, base plate 7, recess 8, and timing indicator 9.

DETAILED DESCRIPTION

This invention is further described in combination with the following embodiments.

Figure 9:
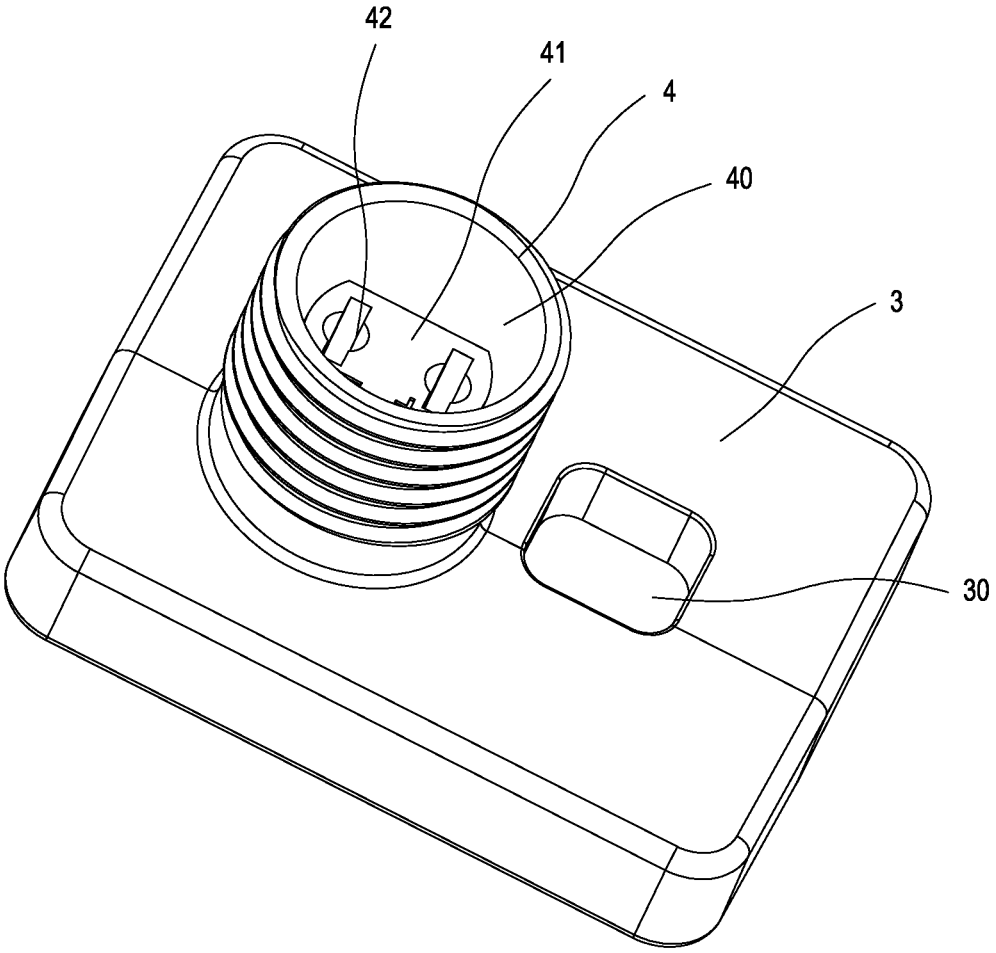
FIG. 9 is a schematic structural diagram of the drive power supply for a lamp at the side of the end cover to a second embodiment of this invention.

A specific implementation of a lamp power supply of this invention, as shown in FIG. 1, FIG. 5, FIG. 6, and FIG. 10, includes a housing 1, a main circuit board 2 disposed in the housing 1 and an end cover 3 connected to an open end of the housing 1. A base plate 7 protrudes downward from a lower surface of the end cover 3. A through hole 30 (as shown in FIG. 9) runs through the base plate 7 and communicates upper and lower surfaces of the end cover 3. A shape of the through hole 30 is non limited, it can be a round through hole or a square through hole. A rubber stopper 31 for pressing down and connected to a circuit board 35 is disposed in the through hole 30. The rubber stopper 31 includes a mounting portion 32 and an elastic pressing portion 33. The mounting portion 32 is of a hollow columnar shape. A second space 34 is provided in the mounting portion 32. The mounting portion 32 is inserted into the through hole 30. The elastic pressing portion 33 is connected to the mounting portion 32. An upper clamp block 320 and a lower clamp block 321 respectively extend at the top and bottom of the mounting portion 32 in directions away from the elastic pressing portion 33. When the rubber stopper 31 is inserted into the through hole 30, the upper clamp block 320 is clamped on the upper surface of the end cover 3 and the lower clamp block 321 is clamped on the bottom of the base plate 7. The upper clamp block 320 and the lower clamp block 321 respectively collaborate with the upper surface of the end cover 3 and the bottom of the base plate 7. The upper clamp block 320 and the lower clamp block 321 are configured for securing the rubber stopper 31 onto the end cover 3, and further preventing the rubber stopper 31 from moving upward or downward, thereby enabling stable securing. The rubber stopper is made of a black or white transparent or fluorescent material, so that the power supply device can be found through the fluorescence of the rubber stopper in the dark. A timing indicator 9 is connected to the sub-circuit board 35, which can be turned on or off after a delay of 4 s.

Figure 10:
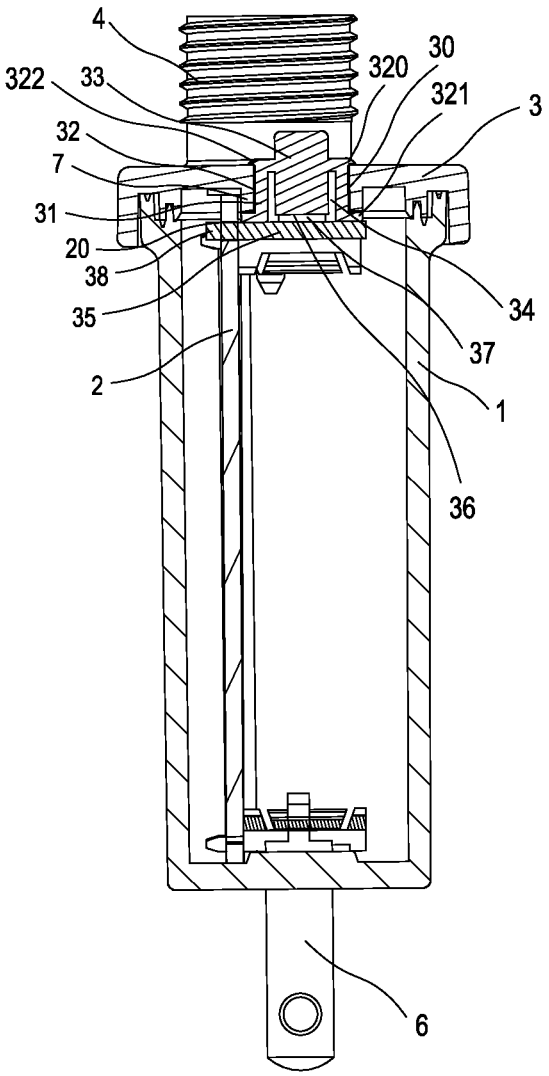
FIG. 10 is a cross-sectional view of the drive power supply for a lamp of this invention.
Figure 11:
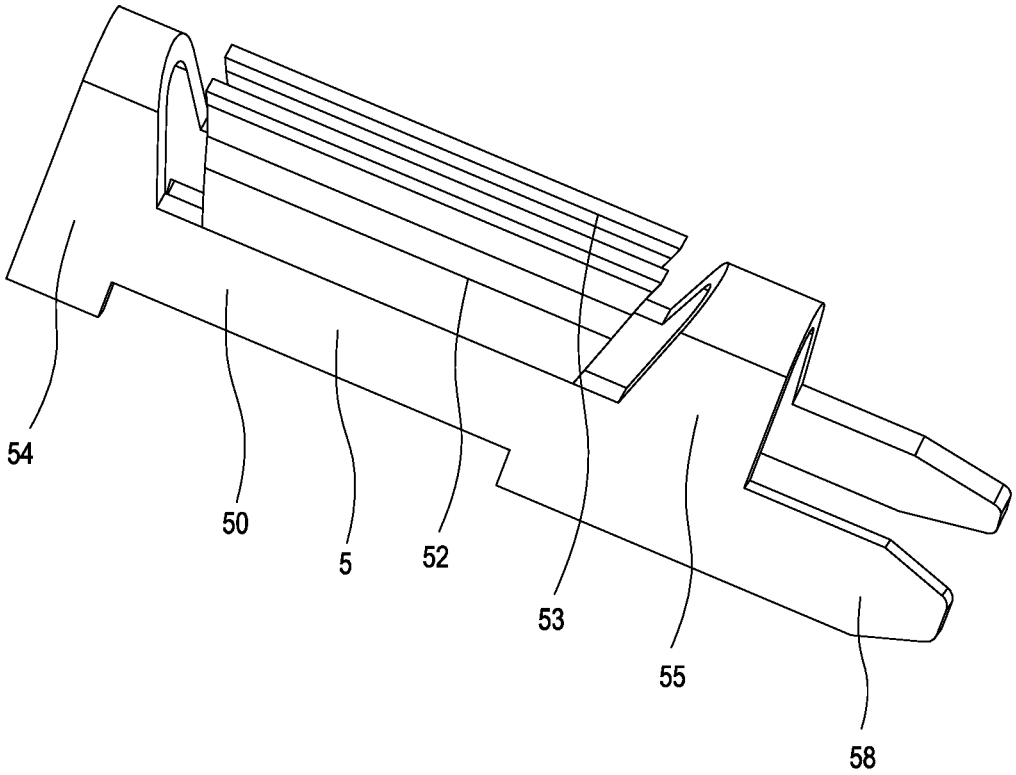
FIG. 11 is a schematic structural diagram of a conductive seat of the drive power supply for a lamp of this invention.
Figure 12:
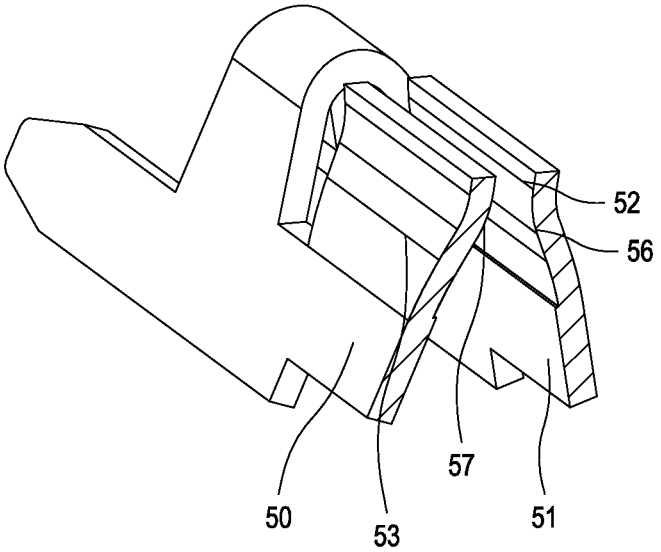
FIG. 12 is a cross-sectional view of the conductive seat of the drive power supply for a lamp of this invention.

As shown in FIG. 10, the upper end of the elastic pressing portion 33 is connected to a middle of the mounting portion 32, extends upward from the mounting portion 32 and protrudes from the surface of the end cover 3, and the lower end of the elastic pressing portion 33 extends downward and is located in the second space 34, so that the mounting portion 32 can protect the lower end of the elastic pressing portion 33. A sub-circuit board 35 is fixedly connected or detachably connected to the bottom of the lower clamp block 321 of the mounting portion 32, and a conductive portion 36 is connected to the lower end of the elastic pressing portion 33. In this embodiment, the conductive portion 36 is coated on the lower end of the elastic pressing portion 33, but this invention is not limited thereto, and in this embodiment, the conductive portion 36 may be secured to the bottom of the elastic pressing portion 33. A first space 37 is provided between the bottom of the elastic pressing portion 33 and the top of the sub-circuit board 35. The first space 37 is communicated with the second space 34. The elastic pressing portion 33 is capable of moving up and down in the first space 37. When the elastic pressing portion 33 is pressed down, the elastic pressing portion 33 moves downward in the first space 37 until the conductive portion 36 at the bottom of the elastic pressing portion 33 comes into contact with the top of the sub-circuit board 35 to implement electrical connection. At this time, the lamp power supply is turned on or other functions are switched over. In this embodiment, the sub-circuit board 35 is electrically connected to the elastic pressing portion 33 of the rubber stopper 31, thereby reducing the material cost. In addition, the rubber stopper 31 is in surface contact with the sub-circuit board 35 through the conductive portions 36, so that the fault tolerance of the whole structure is increased, the rubber stopper 31 and the sub-circuit board 35 have a good fastening performance and are not apt to separate from each other, and the situation, like what occurs by using a conventional mechanical switch, which is inclinedly inserted into the circuit board to cause a poor performance of the switch, will not occur. In this embodiment, by configuring the above-mentioned structure, the defective rate of products is reduced and the cost is saved. The sub-circuit board 35 is connected to the bottom of the mounting portion 32 and the lower end of the elastic pressing portion 33 is located in the second space 34. Therefore, a movement range of the elastic pressing portion 33 is restrained to the second space 34, and when the elastic pressing portion 33 is pressed downward inclinedly toward one side, the elastic pressing portion 33 still has a downward pressing force, so that the conductive portion 36 of the elastic pressing portion 33 is electrically connected to the sub-circuit board 35, which can also implement conduction and have a flexible connection.

As shown in FIG. 10, the main circuit board 2 is provided with a catching slot 20, and a convex block 38 extends from a left side of the sub-circuit board 35 toward the main circuit board 2. The convex block 38 can be inserted into the catching slot 20. The convex block 38 of the sub-circuit board 35 is clamped with the catching slot 20 of the main circuit board 2, and the connection between the sub-circuit board 35 and the main circuit board 2 is secured by solder, so that the connection thereof is more stable.

Figure 5:
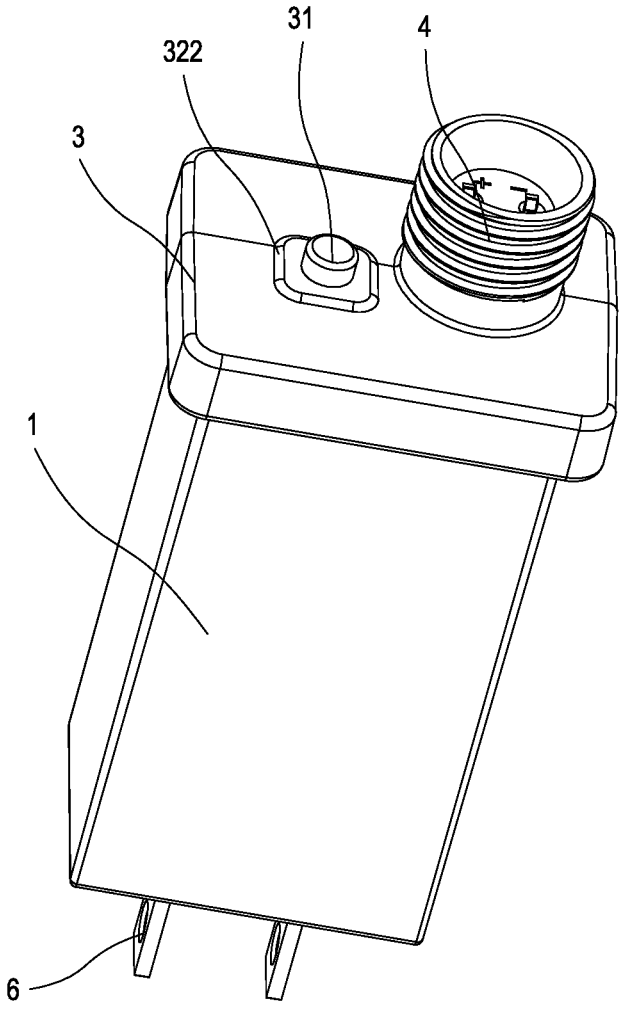
FIG. 5 is a schematic structural diagram of a drive power supply for a lamp of this invention.
Figure 6:
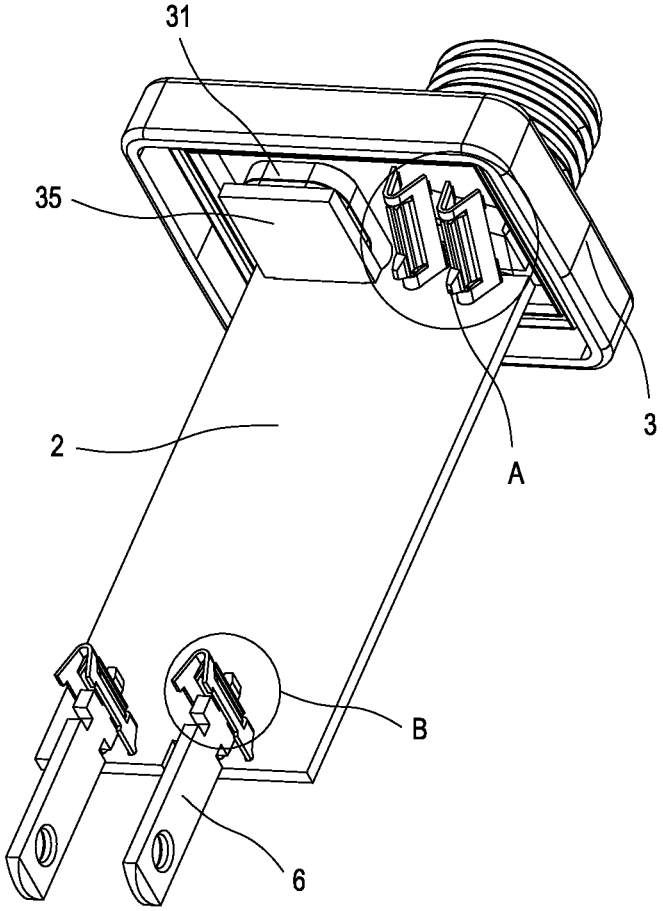
FIG. 6 is a view of a connection of a circuit board and an end cover of the drive power supply for a lamp of this invention.
Figure 7:
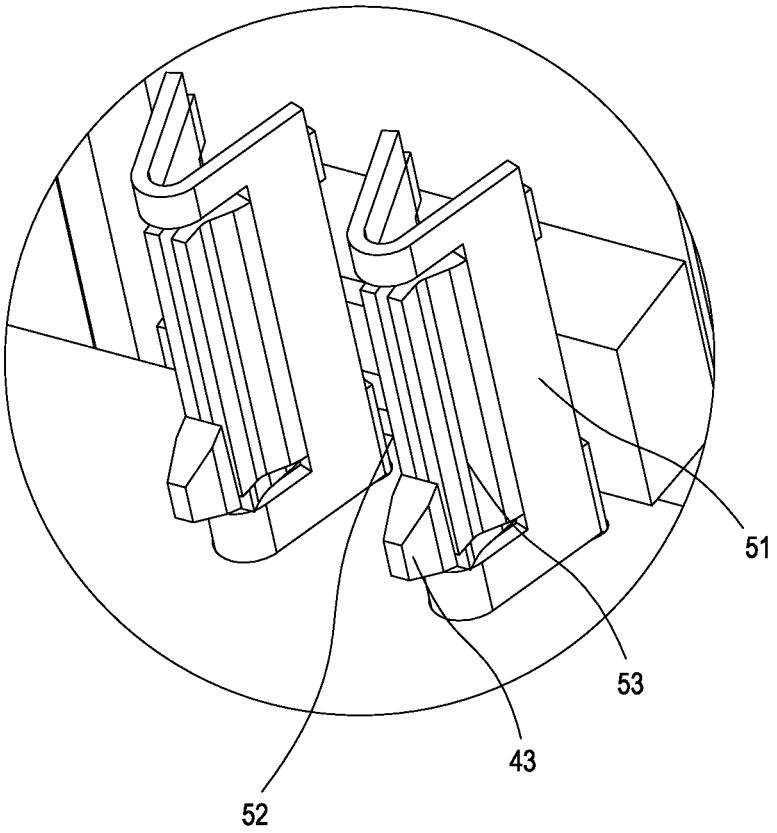
FIG. 7 is a partial enlarged view of a position A in FIG. 6.
Figure 8:
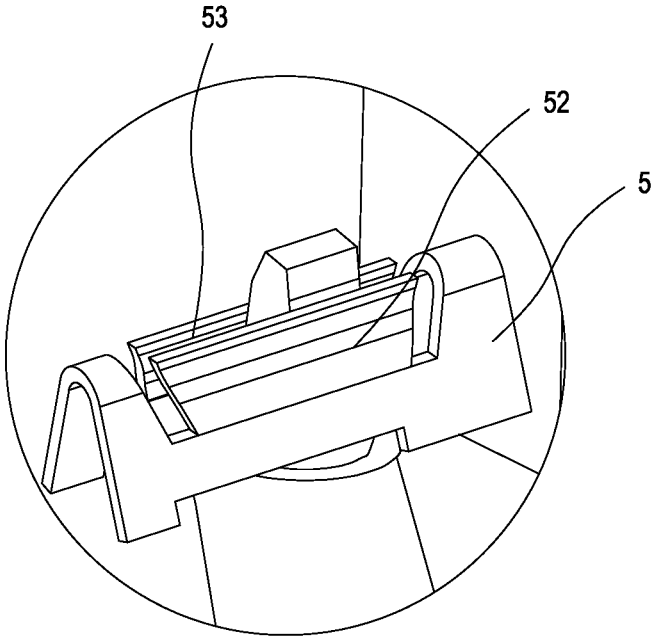
FIG. 8 is a partial enlarged view of a position B in FIG. 6 after rotating clockwise by 90°.

As shown in FIG. 10, the top of the upper clamp block 320 is provided with a guide portion 322 (as shown in FIG. 5). In a case in which guide portion 322 is an inclined surface or a curved surface, during installation, when the rubber stopper 31 is inserted into the through hole 30 from bottom to top, the guide portion 322 of the rubber stopper 31 first passes through the through hole 30. The guide portion 322 is configured as the curved surface or the inclined surface, and therefore the guiding effect between the rubber stopper 31 and the through hole 30 can be improved, and the rubber stopper 31 can pass through the through hole 30 more conveniently.

Figure 13:
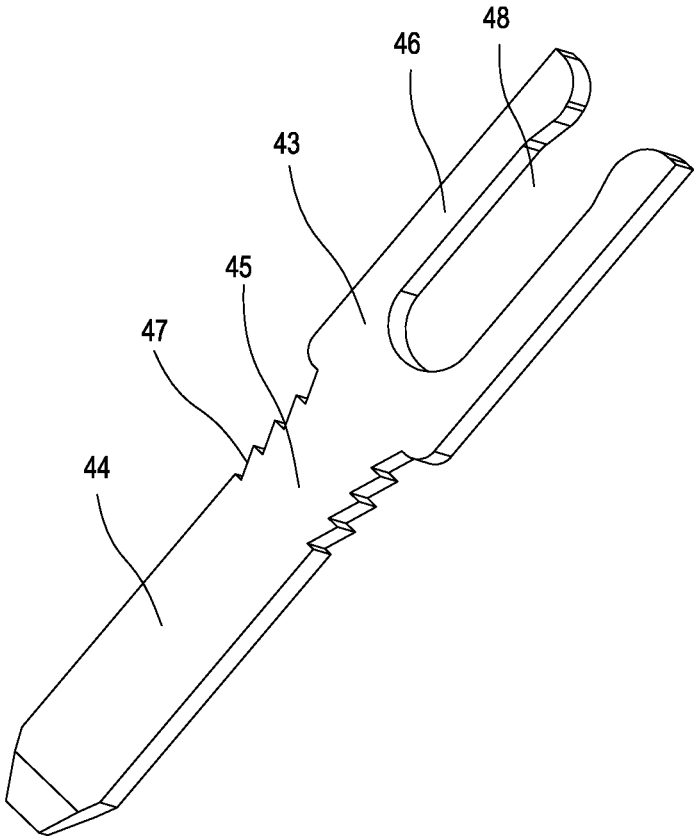
FIG. 13 is a schematic structural diagram of a conductive sheet of the drive power supply for a lamp of this invention.

As shown in FIG. 9 and FIG. 13, the top of the end cover 3 is further provided with a terminal post 4, an outer side wall of which is provided with external threads to be threaded with the lamp. A receiving groove 40 is provided in the terminal post 4. A boss 41 is disposed in the receiving groove 40. The boss 41 extends upward from a bottom wall of the receiving groove 40 and is provided with two conductive holes 42. A pair of conductive sheets 43 are respectively disposed in the two conductive holes 42. The conductive sheets 43 each include an insertion section 44, a fastening section 45, and a conductive section 46. The fastening section is provided with a plurality of inverted teeth 47. When the conductive sheets 43 are mounted, the conductive sheets 43 are inserted upward from the bottom of the conductive holes 42, so that the inverted teeth 47 on the fastening sections are engaged with inner side walls of the conductive holes 42, which can prevent the conductive sheets 43 from dropping off from the conductive holes 42, thereby enabling stable securing. The conductive sections 46 extend upward from the fastening sections 45, and a U-shaped groove 48 separate the conductive sections 46 into left and right conductive sections. The plug connector of the lamp is inserted into the U-shaped groove 48 and is electrically connected to the left and right conductive sections 46.

As shown in FIG. 6 to FIG. 8, FIG. 11 and FIG. 12, two conductive seats 5 are disposed on the circuit board 2. The two conductive seats 5 are respectively inserted with a pair of conductive sheets 43 to implement electrical connection. Each conductive seat 5 includes a first main board 50, a second main board 51, a first elastic sheet 52, a second elastic sheet 53, a first connecting sheet 54, and a second connecting sheet 55. The second main board 51 has the same structure as the first main board 50. The first elastic sheet 52 is formed by extending upward from the first main board 50 and the second elastic sheet 53 is formed by extending upward from the second main board 51. Free ends of the first and second elastic sheets 52 and 53 first retract inward and then expand outward. The first main board 50 and the second main board 51 correspond in position, an end portion at an end of the first main board 50 is connected to an end portion at an end of the second main board 51 by the first connecting sheet 54, and an end portion at an other end of the second main board 51 is connected to an end portion at an other end of the first main board 50 by the second connecting sheet 55. Free ends of the first and second connecting sheets 54 and 55 expand outward. Directions in which the free ends of the first and second elastic sheets 52 and 53 expand outward are directions toward an interior of the housing 1. Directions in which the free ends of the first and second connecting sheets 54 and 55 expand outward are directions away from the interior of the housing 1. The conductive sheets 43 are inserted downward into gaps between the first and second elastic sheets 52 and 53 from the free ends of the first and second connecting sheets 54 and 55. An insertion member 58 extends from each of the first main board 50 and the second main board 51 in a direction toward the circuit board 2. The two insertion members 58 are inserted into plug-holes in the circuit board 2 for connecting the conductive sheets 43 to the circuit board 2 through the conductive seats 5.

The first elastic sheet 52 and the second elastic sheet 53 are configured to press side walls of the insertion sections 44 of the conductive sheets 43. An end portion of each of the conductive sheets 43 protrudes from an upper surface of the first elastic sheet 52 and an upper surface of the second elastic sheet 53, and extends toward the interior of the housing 1. The first elastic sheet 52 is provided with a first contact portion 56 for pressing a side of the conductive sheet 43. The first contact portion 56 is located at the connecting portion between the retraction section and the expansion section of the first elastic sheet 52. The second elastic sheet 53 is provided with a second contact portion 57 for pressing an other side of the conductive sheet 43. The second contact portion 57 is located at the connecting portion between the retraction section and the expansion section of the second elastic sheet 53. The first contact portion 56 protrudes toward the second contact portion 57. The second contact portion 57 protrudes toward the first contact portion 56. The insertion sections 44 on the conductive sheets 43 protrude into gaps between the first and second elastic sheets 52 and 53. The first and second elastic sheets 52 and 53 tightly press the conductive sheets 43 to prevent the conductive sheets 43 from dropping off from the conductive seats 5. Further, a width between the first and second contact portions 56 and 57 is less than or equal to a thickness of each of the conductive sheets 43, so that the conductive sheets 43 can be more stably pressed in the conductive seats 5 to prevent the conductive sheets 43 from dropping off from the conductive seats 5. In this invention, electrical connection is implemented by the insertion structure for mating the conductive seats 5 disposed on the circuit board 2 and the conductive sheets 43. In this way, compared with the conventional structure in which the conductive sheets 43 and the circuit board 2 are connected by wires, this embodiment has the advantage of convenient production. In addition, in this embodiment, end portions of the conductive sheets 43 protrude from the upper surface of the first elastic sheet 52 and the upper surface of the second elastic sheet 53, so that most of the conductive sheets 43 can protrude from the upper surface of the first elastic sheet 52 and the upper surface of the second elastic sheet 53. By the structural configuration, more force is required during insertion and removal, the conductive sheets 43 are not easy to drop off due to shaking, or the conductive sheets 43 are not easy to pull put due to a misoperation, thus preventing misoperations. The first contact portion 56 protrudes toward the second contact portion 57. The second contact portion 57 protrudes toward the first contact portion 56. A width between the first and second contact portions 56 and 57 is less than or equal to an outer diameter of each of the conductive sheets 43. The conductive sheets 43 are pressed between the first and second elastic sheets 52 and 53 by an elastic force of the first elastic sheet 52 and an elastic force of the second elastic sheet 53, to prevent the conductive sheets 43 from dropping off from the gaps between the first and second elastic sheets 52 and 53. Even if the conductive sheets 43 are inserted and removed a plurality of times, the conductive sheets 43 can still be pressed in the gaps between the first and second elastic sheets 52 and 53.

A pair of conductive pins 6 are disposed at a tail end of the housing 1. An end of each of the conductive pins 6 is configured to be electrically connected to a socket and an other end of each of the conductive pins 6 is inserted into the housing 1. Two conductive seats 5 having the same structure as described above are disposed on the circuit board 2. The two conductive seats 5 are respectively inserted with the pair of conductive pins 6 to implement electrical connection. Each conductive seat 5 includes a first main board 50, a second main board 51, a first elastic sheet 52, a second elastic sheet 53, a first connecting sheet 54, and a second connecting sheet 55. The first elastic sheet 52 is formed by extending upward from the first main board 50 and the second elastic sheet 53 is formed by extending upward from the second main board 51. Free ends of the first and second elastic sheets 52 and 53 first retract inward and then expand outward. The first main board 50 and the second main board 51 correspond in position, an end portion at an end of the first main board 50 is connected to an end portion at an end of the second main board 51 by the first connecting sheet 54, the end portion of the first main board 50 and the end portion of the second main board 51 are located at the same end, an end portion at an other end of the second main board 51 is connected to an end portion at an other end of the first main board 50 by the second connecting sheet 55, and the end portion of the first main board 50 and the end portion of the second main board 51 are located at the same end. Free ends of the first and second connecting sheets 54 and 55 expand outward. Directions in which the free ends of the first and second elastic sheets 52 and 53 expand outward are directions toward an interior of the housing 1. Directions in which the free ends of the first and second connecting sheets 54 and 55 expand outward are directions away from the interior of the housing 1. The conductive pins 6 are inserted upward into gaps between the first and second elastic sheets 52 and 53 from the free ends of the first and second connecting sheets 54 and 55. An insertion member 58 extends from each of the first main board 50 and the second main board 51 in a direction toward the circuit board 2. The two insertion members 58 are inserted into plug-holes in the circuit board 2 for connecting the conductive pins 6 to the circuit board 2 through the conductive seats 5.

The first elastic sheet 52 and the second elastic sheet 53 are configured to press outer side walls of the conductive pins 6. An end portion of each of the conductive pins 6 protrudes from an upper surface of the first elastic sheet 52 and an upper surface of the second elastic sheet 53, and extends toward the interior of the housing 1. The first elastic sheet 52 is provided with a first contact portion 56 for pressing a side of the conductive pin 6. The first contact portion 56 is located at the connecting portion between the retraction section and the expansion section of the first elastic sheet 52. The second elastic sheet 53 is provided with a second contact portion 57 for pressing an other side of the conductive pin 6. The second contact portion 57 is located at the connecting portion between the retraction section and the expansion section of the second elastic sheet 53. The first contact portion 56 protrudes toward the second contact portion 57. The second contact portion 57 protrudes toward the first contact portion 56. A width between the first and second contact portions 56 and 57 is less than or equal to an outer diameter of each of the conductive pins 6, so that the conductive pins 6 can be tightly pressed in the conductive seats 5 to prevent the conductive pins 6 from dropping off from the conductive seats 5. Compared with the conventional structure in which the conductive seat 5 includes a pair of elastic sheets pressed on the outer side walls of the conductive pins 6 and a connecting sheet for connecting the pair of elastic sheets, the elastic sheets and the connecting sheet are integrally formed, and inner side walls of the elastic sheets are provided with a plurality of anti-skid grooves distributed along a length direction of the elastic sheets, in this embodiment, end portions of the conductive pins 6 protrude from the upper surface of the first elastic sheet 52 and the upper surface of the second elastic sheet 53, so that most of the conductive pins 6 can protrude from the upper surface of the first elastic sheet 52 and the upper surface of the second elastic sheet 53, and by the structural configuration, more force is required during insertion and removal, the conductive pins 6 are not easy to drop off due to shaking, or the conductive pins 6 are not easy to pull put due to a misoperation, thus preventing misoperations. The first contact portion 56 protrudes toward the second contact portion 57. The second contact portion 57 protrudes toward the first contact portion 56. A width between the first and second contact portions 56 and 57 is less than or equal to an outer diameter of each of the conductive pins 6. The conductive pins 6 are pressed between the first and second elastic sheets 52 and 53 by an elastic force of the first elastic sheet 52 and an elastic force of the second elastic sheet 53, to prevent the conductive pins 6 from dropping off from the gaps between the first and second elastic sheets 52 and 53. Even if the conductive pins 6 are inserted and removed a plurality of times, the conductive pins 6 can still be pressed in the gaps between the first and second elastic sheets 52 and 53.

Figure 2:
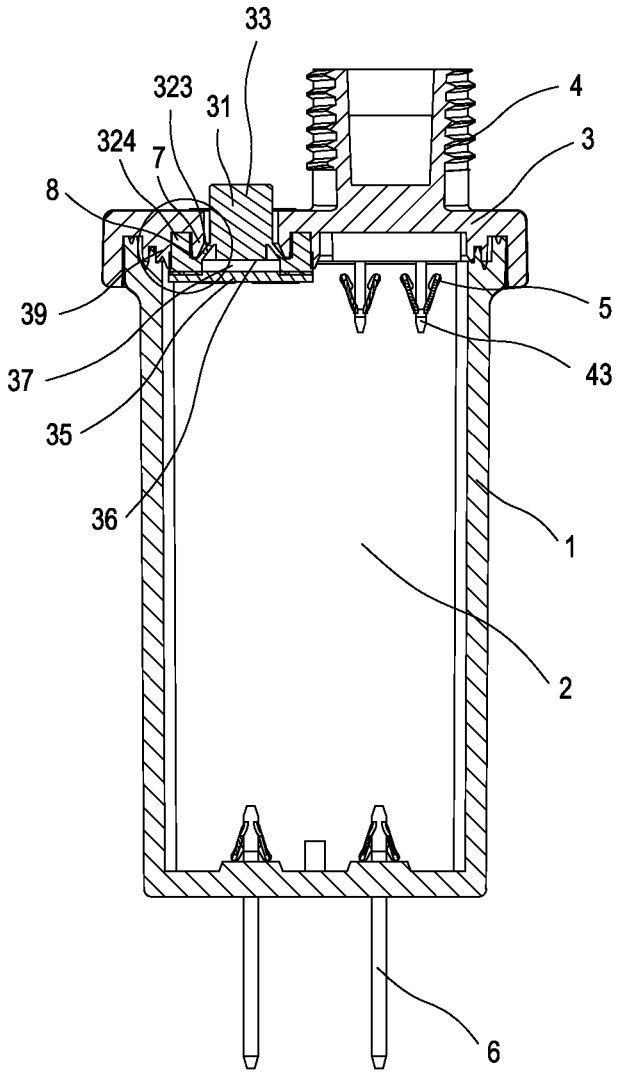
FIG. 2 is a cross-sectional view of a drive power supply for a lamp according to a second embodiment of this invention.
Figure 3:
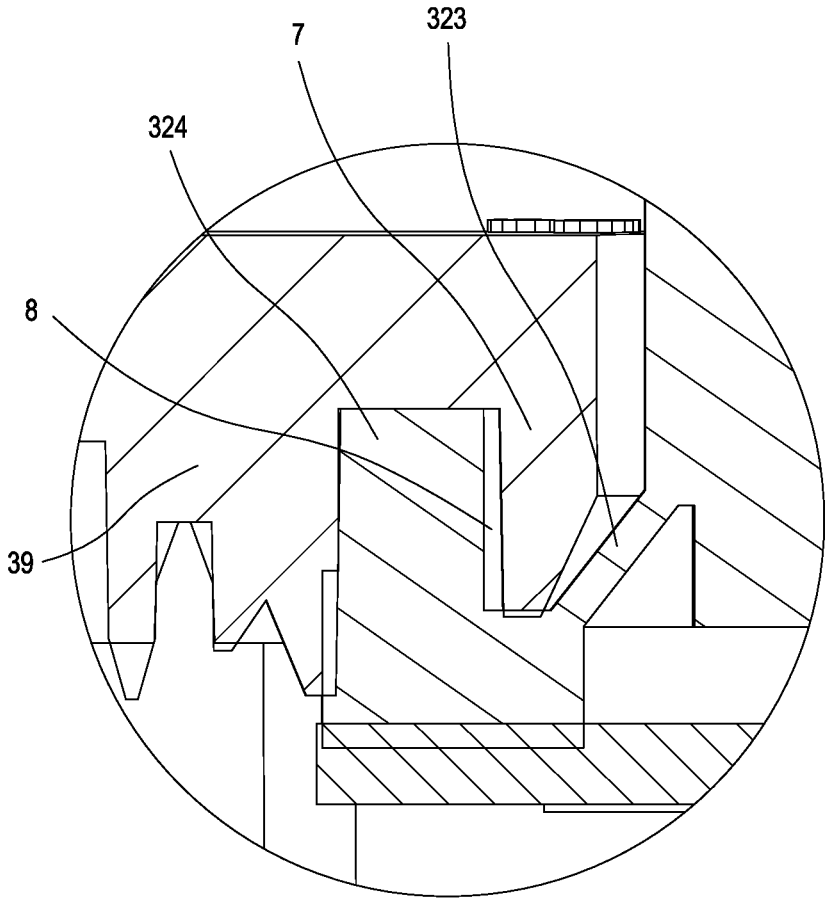
FIG. 3 is a partial enlarged view of the circled part in FIG. 2.
Figure 4:
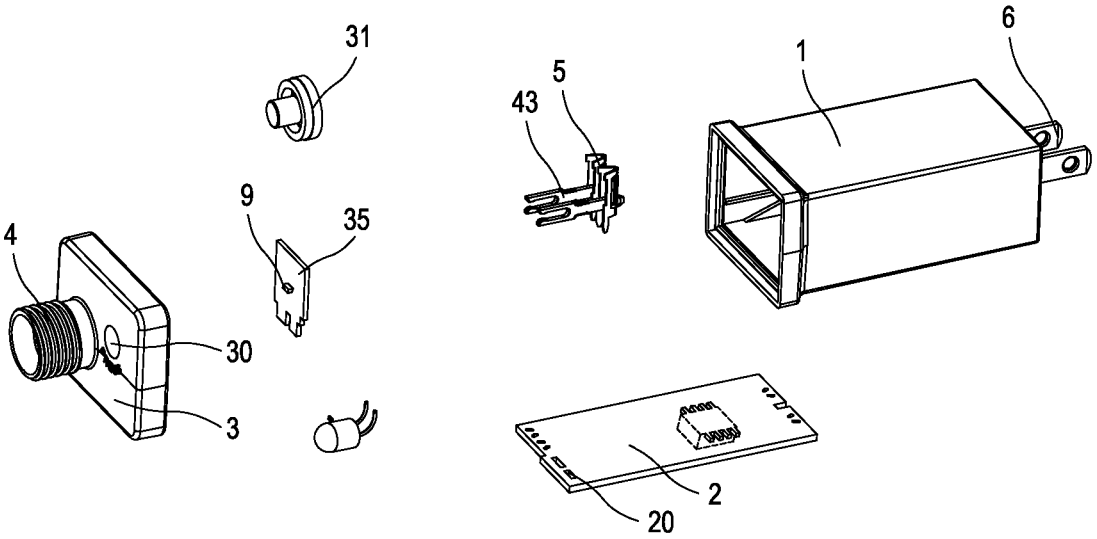
FIG. 4 is an exploded view of the drive power supply for a lamp according to the second embodiment of this invention.

As shown in FIG. 2, 3 and FIG. 4, in a second embodiment of the rubber stopper, provided is another structure of the rubber stopper 31 in the above-mentioned structure (the other structures remain unchanged, and the specific structure of the rubber stopper is as follows): the rubber stopper 31 includes a mounting portion 32 and an elastic pressing portion 33; the mounting portion 32 includes an elastic portion 323 and a lower clamp block 321; the elastic portion 323 is annularly disposed and connected to the lower end of the elastic pressing portion 33; the lower clamp block 321 is connected to the bottom of the elastic portion 323; the lower clamp block 321 is located between the sub-circuit board 35 and the bottom of the base plate 7; the conductive portion 36 is coated on the bottom of the elastic pressing portion 33; a first space 37 is provided between the conductive portion 36 and the sub-circuit board 35; when the elastic pressing portion 33 is pressed downward, the elastic pressing portion 33 moves downward in the first space 37 until the conductive portion 36 at the bottom of the elastic pressing portion 33 comes into contact with an exposed circuit at the top of the sub-circuit board 35 to implement electrical connection; and at this time, the lamp power supply is turned on or other functions are switched over.

An annular convex plate 39 protrudes downward from the lower surface of the end cover 3, the convex plate 39 coincides with a central axis of the through hole 30, the base plate 7 is annular, and the convex plate 39 is located on an outer side of the base plate 7. A recess 8 is provided between the convex plate 39 and the base plate 7. A connecting block 324 protrudes upward from the lower clamp block 321 and toward an interior of the recess 8. When the rubber stopper 31 is inserted into the through hole 30, the connecting block 324 is inserted into the recess 8 and the base plate 7 is inserted between the elastic portion 323 and the connecting block 324. With such the structural configuration, the base plate 7 is used as a first waterproof ring, the connecting block is used as the second waterproof ring, the convex plate 39 is clamped with the connecting block 324 of the rubber stopper 31 and is further used as a third waterproof ring while positioning the rubber stopper 31; and by disposing the base plate 7, the connecting block 324, and the convex plate 39 in different orientations, there are three waterproof rings when the rubber stopper 31 is fixedly connected to the end cover 3, thereby having a good waterproof effect.

The elastic portion 323 is disposed inclinedly, an end of the elastic portion 323 is connected to the lower end of the elastic pressing portion 33, and an other end of the elastic portion 323 extends in a direction away from the elastic pressing portion 33; and by such the structural configuration, as compared with a vertically disposed elastic portion 323, the inclinedly disposed elastic portion 323 is capable of providing a better elastic deformation, to better control a movement of the elastic pressing portion 33 and enable the elastic pressing portion 33 to quickly return to an original position after a pressing force is removed, thereby having a good resilience.

Figure 14:
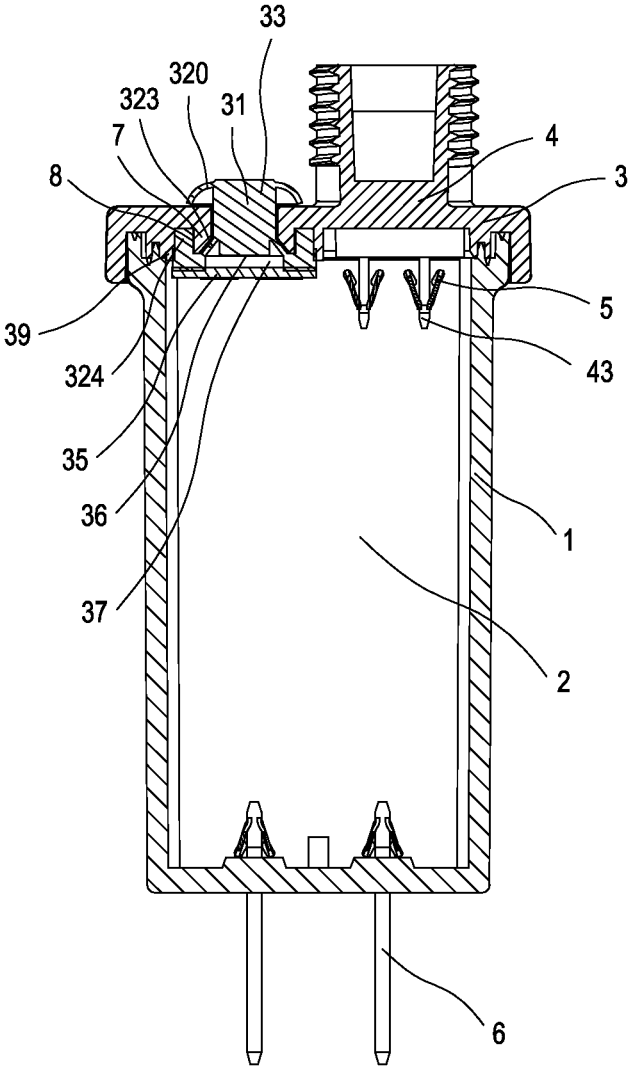
FIG. 14 is a cross-sectional view of a drive power supply for a lamp according to a third embodiment of this invention.

As shown in FIG. 14, in a third embodiment of the rubber stopper, that is, the rubber stopper 31 in the second embodiment has another structure (the other structures remain unchanged, and the specific structure of the rubber stopper is as follows): the upper end of the elastic pressing portion is connected with an upper clamp block, an end of the upper clamp block is connected to the top of the elastic pressing portion, and an other end of the upper clamp block extends downward and toward the upper surface of the end cover; the upper clamp block as a whole is inverted and is capable of wrapping the through hole therein, thereby achieving a waterproof effect; in addition, the upper clamp block 320 and the lower clamp block 321 respectively collaborate with the upper surface of the end cover 3 and the bottom of the base plate 7, and the upper clamp block 320 and the lower clamp block 321 are configured for securing the rubber stopper 31 onto the end cover 3, and further preventing the rubber stopper 31 from moving upward or downward, thereby enabling stable securing.

Finally, it should be noted that the above embodiments are only used to illustrate the technical solution of this invention, but not limited thereto. Although this invention has been described in detail with reference to the preferred embodiments, a person of ordinary skill in the art should understand that modifications to or equivalent replacements can be made to the technical solutions of this invention, which do not depart from the essence and scope of the technical solution of this invention.

What is claimed is:

1. A lamp power supply, comprising a housing, a main circuit board, and an end cover, the circuit board being disposed in the housing and the end cover being connected to an open end of the housing, wherein the end cover is provided with a through hole running through a surface of the end cover, a rubber stopper is disposed in the through hole, and the rubber stopper comprises an elastic pressing portion protruding upward from the surface of the end cover and a conductive portion connected to a lower end of the elastic pressing portion and located in the through hole; and the lamp power supply further comprises a sub-circuit board electrically connected to the main circuit board, a first space is provided between the sub-circuit board and a bottom of the elastic pressing portion, and when the elastic pressing portion is pressed downward, the elastic pressing portion is capable of moving in the first space and enabling a circuit of the sub-circuit board to be in electrical contact with the conductive portion to generate a pulse signal, to switch a function of a power supply device, wherein the rubber stopper comprises a mounting portion and the elastic pressing portion, the mounting portion comprises an elastic portion and a lower clamp block connected to a bottom of the elastic portion, the elastic portion is annularly disposed and connected to the lower end of the elastic pressing portion, a base plate protrudes downward from a lower surface of the end cover, the through hole runs downward through the base plate and communicates upper and lower surfaces of the end cover, and the lower clamp block is located between the sub-circuit board and a bottom of the base plate.

2. The lamp power supply according to claim 1, wherein an annular convex plate protrudes downward from a lower surface of the end cover, the convex plate coincides with a central axis of the through hole and is located on an outer side of the base plate, a recess is provided between the convex plate and the base plate, a connecting block protrudes upward from the lower clamp block and toward an interior of the recess, the base plate is capable of being inserted downward between the elastic portion and the connecting block, and when the rubber stopper is inserted into the through hole, the connecting block is inserted upward into the recess and the base plate is inserted downward between the elastic portion and the connecting block; with such the structural configuration, the base plate is used as a first waterproof ring, the connecting block is used as the second waterproof ring, the convex plate is clamped with the connecting block of the rubber stopper and is further used as a third waterproof ring while positioning the rubber stopper; and by disposing the base plate, the connecting block, and the convex plate in different orientations, there are three waterproof rings when the rubber stopper is fixedly connected to the end cover, to play a role of waterproof sealing.

3. The lamp power supply according to claim 1, wherein the elastic portion is disposed inclinedly, an end of the elastic portion is connected to the lower end of the elastic pressing portion, and an other end of the elastic portion extends in a direction away from the elastic pressing portion; and by such the structural configuration, as compared with a vertically disposed elastic portion, the inclinedly disposed elastic portion is capable of providing a better elastic deformation, to better control a movement of the elastic pressing portion and enable the elastic pressing portion to quickly return to an original position after a pressing force is removed, thereby having a good resilience.

4. The lamp power supply according to claim 1, wherein the rubber stopper further comprises an upper clamp block, an end of the upper clamp block is connected to a top of the elastic pressing portion, and an other end of the upper clamp block extends downward and toward an upper surface of the end cover.

5. The lamp power supply according to claim 1, wherein an upper clamp block and a lower clamp block respectively extend from top and bottom of the mounting portion in directions away from the elastic pressing portion, a base plate protrudes downward from a lower surface of the end cover, the through hole runs downward through the base plate and communicates upper and lower surfaces of the end cover, and the upper clamp block and the lower clamp block respectively collaborate the upper surface of the end cover and the bottom of the base plate and secure the rubber stopper onto the end cover; and a top of the upper clamp block is provided with a guide portion capable of guiding the rubber stopper to be inserted into the through hole from bottom to top, and the guide portion is an inclined surface or a curved surface.

* * * * *